US005845570A

United States Patent [19]

Isozaki et al.

[11] Patent Number: 5,845,570

[45] **Date of Patent: *Dec. 8, 1998**

[54] PRINT IMAGE TREATMENT DEVICE

[75] Inventors: Takashi Isozaki; Ryuji Higa; Takahito Tojima; Sadanao Okuda, all of Ibaraki-ken, Japan

[73] Assignee: Riso Kagaku Corporation, Tokyo, Japan

[ * ] Notice: The term of this patent shall not extend beyond the expiration date of Pat. No. 5,476,034.

[21] Appl. No.: 618,199

[22] Filed: Mar. 19, 1996

[30] Foreign Application Priority Data

Mar. 31, 1995 [JP] Japan ..... 7-075406

[51] Int. Cl.[6] ..... B41L 13/04

[52] U.S. Cl. ..... 101/116; 101/416.1; 101/424.2

[58] Field of Search ..... 101/116, 424.2, 101/424, 1, 416.1

*Primary Examiner*—Edgar S. Burr
*Assistant Examiner*—Anthony H. Nguyen
*Attorney, Agent, or Firm*—Kanesaka & Takeuchi

[57] ABSTRACT

A print image treatment device is formed of a supply device for holding an excess ink removing liquid, the excessive ink removing liquid not dissolving in a printing ink forming a print image and having a lower surface tension than that of the printing ink; a rotating contact member having an outer surface, on which the excessive ink removing liquid is supplied from the supply device; a facing member situated under the contact member for nipping and carrying a printing sheet between the contact member and the facing member, an excessive printing ink forming the print image on a printing sheet being transferred to the excessive printing ink removing liquid when the printing sheet contacts the contacting member; a cleaning device contacting the contact member for removing the excessive printing ink with the excessive ink removing liquid; and a separation device receiving the excessive ink removing liquid with the excessive printing ink. The excessive ink removing liquid is separated from the printing ink having been transferred from the printing sheet. The separation device includes a filter having the thickness and air-flow resistance indicated below:

$0.05 <$ air-flow resistance/thickness (Kpa·sec/m$^2$).

6 Claims, 5 Drawing Sheets

FIG. 4

| | VENTILATION RESISTANCE (kPa · sec/m) | THICKNESS | AIR-FLOW RESISTANCE PER UNIT THICKNESS (kPa · sec/m²) | COMPONENTS |
|---|---|---|---|---|
| EXAMPLE 1 | 0.0483 | 10.0 | 4.83 | NONWOVEN FABRIC |
| EXAMPLE 2 | 0.0373 | 13.0 | 2.86 | NONWOVEN FABRIC |
| EXAMPLE 3 | 0.0053 | 13.5 | 0.39 | NONWOVEN FABRIC |
| EXAMPLE 4 | 0.0592 | 18.0 | 3.29 | SPONGE |
| EXAMPLE 5 | 0.0994 | 15.0 | 6.62 | NONWOVEN FABRIC |
| EXAMPLE 6 | 0.0009 | 18.0 | 0.05 | NONWOVEN FABRIC |
| COMPARATIVE EXAMPLE | 0.0004 | 10.0 | 0.04 | NONWOVEN FABRIC |

FIG. 5

| | INK SEPARATING PERFORMANCE |
|---|---|
| EXAMPLE 1 | ○ |
| EXAMPLE 2 | ○ |
| EXAMPLE 3 | ○ |
| EXAMPLE 4 | ○ |
| EXAMPLE 5 | ○ |
| EXAMPLE 6 | △ |
| COMPARISON EXAMPLE | × |

PRINT IMAGE TREATMENT DEVICE

BACKGROUND OF THE INVENTION

The present invention relates to a print image treatment device used in a stencil printing device or the like. The present invention is effective as a measure particularly for a set-off and seeping-through in printing.

In the printing using liquid printing ink, there have been as problems, a set-off, a symptom that a printing ink forming a print image on a printed sheet or body sticks to the back surface of another placed thereon, when it is printed piled up immediately after printing; a print image deformation occurring when a finger touches on a print image surface immediately after printing; and a seeping-through, a symptom that a printing ink forming a print image on a printed body penetrates through the printed body to the back surface.

These problems as mentioned above are apt to appear particularly in a stencil printing which uses excessive quantity of printing ink, in forming a print image on a printed body, compared to the other type of printing.

Efforts have been made to reduce a quantity of ink applied to a printing sheet in printing processes to prevent a set-off, seeping-through, or the like from occurring. However, it is difficult to quantitatively control ink; overcontrolling a quantity of ink will cause a print image to be thin or to blur, and will lower the printing quality.

To avoid problems as mentioned above, it is considered to heat and dry a printing ink forming a print image, but this method needs a heater having a considerably high calorific power. When a drying means by a heater or the like dries a printed sheet or body, conditions imposed on the drying means are more strict as the printing speed of a printing machine gets higher. Practically, it is impossible to dry a printing ink in such a high speed as prevents a set-off, seeping-through, or the like from occurring.

Furthermore, depending on a printing system, a fine powder such as starch or talc can be applied to a print image for preventing a set-off. However, a device for applying these fine powders uses compressed air; a printing device having this type of device is apt to be considerably large.

And, when a printed body is transferred to a discharge paper tray, sorter, or the like after printing, it is impossible to allow a transfer roller to touch a print image on the printed body to keep the print image in a good condition. Thus, a conveyer belt has been used to transfer the printed body as a transfer mechanism, which only touches the back surface (non-printed surface) of the printed body. The printed body transfer device of this type has been disclosed in, for instance, Japanese Patent Laid Open No. 50-88769.

However, compared to a transfer system used in a PPC copy machine or the like that transfers a copying paper forcefully by nipping both sides, the system transferring a printed body without touching a print image surface, but touching a back surface only, creates irregularities in paper setting in a transferred place such as a discharged paper tray or sorter; consequently deteriorating the neatness of a discharged paper. This tendency is more obvious as a printing speed, in other words, a paper discharging speed becomes higher. And, these problems drastically reduce the degree of freedom for designing a paper carrying and discharging path in the printing device.

The inventors of the present invention invented a new device that removes an excessive printing ink from a printed sheet or body to enhance the quality of printing. This device comprises a contact roller on the surface of which an excessive ink removing liquid is applied in a layered form while rotating, and a facing roller rotating face to face with the contact roller, so that the printed body is transferred by the contact roller and facing roller. And, an excessive printing ink of the print image on the printed body is transferred to the excessive ink removing liquid applied in a layered form on the contact roller; the excessive printing ink on the contact roller is removed by a cleaning means such as a blade being in contact with the contact roller.

The excessive ink removing liquid used the device mentioned above does not dissolve in the printing ink and is a liquid having a lower surface tension than that of the printing ink. Therefore, when the excessive ink is removed from the printed body to the contact roller where the excessive ink removing liquid has been applied, the excessive ink is dispersed in the excessive ink removing liquid; it requires device to separate the excessive ink from the excessive ink removing liquid to reuse the excessive ink.

From the view point mentioned above, the present invention intends to improve the excessive ink removing device according to the inventors' proposal; and therefore, it is an object of the present invention to provide a print image treatment device capable of reliably preventing a set-off, seeping-through or the like from occurring on the printed body without other faults induced; and additionally, the excessive ink removing liquid is used again in removing the excessive part of the printing ink.

SUMMARY OF THE INVENTION

The print image treatment device in the first aspect of the invention comprises a contact member on which an excessive ink removing liquid not dissolving in a printing ink forming a print image and having a lower surface tension than the printing ink is applied, and which is rotated, a facing member for transferring the excessive part of the printing ink forming the print image on the printed sheet or body to the excessive ink removing liquid by nipping and carrying the printed body having been printed between the contact member and the facing member, a supply means for supplying the excessive ink removing liquid to the contact member, a cleaning means for removing the excessive ink having been transferred to the contact roller with the excessive ink removing liquid, and a separation means for separating the excessive ink removing liquid containing the excessive printing ink transferred from the printed body into the excessive ink removing liquid and the printing ink; where the separation means satisfies the relational expression between the thickness and air-flow resistance of a filter: $0.05<\text{ventilation resistance/thickness}$ [kPa·sec/m$^2$].

The print image treatment device in the second aspect of the invention is that, in the print image treatment device in the first aspect, the cleaning means is formed of a plate member being in contact with a surface of the contact member before the top, in the rotating direction of the contact member.

The print image treatment device in the third aspect of the invention is that, in the print image treatment device in the second aspect, the supply means supplies the excessive ink removing liquid on a surface of the contact member before the contact position formed by the plate member and the contact member, in the rotating direction of the contact member.

The print image treatment device in the fourth aspect of the invention is that, in the print image treatment device in the third aspect, a sheet elastic body for recovering the excessive ink removing liquid is in contact with a surface of the contact member on the front side of the contact position formed by the plate member and the contact member, in the rotating direction of the contact member.

The print image treatment device in the fifth aspect of the invention is that, in the print image treatment device in the first aspect, the contact member is comprised of an endless belt loaded on a plurality of rollers.

The print image treatment device in the sixth aspect of the invention is that, in the print image treatment device in the first aspect, the contact member is a contact roller to nip the printed body already printed between the facing member and the contact member.

In operation, the excessive ink removing liquid applied on the surface of the contact member comes into contact with the surface of the print image on the printed body. The excessive part of the printing ink forming the print image is transferred to the layer of the excessive ink removing liquid on the contact member, and is removed from the printed body. The excessive ink removing liquid does not dissolve in the printing ink forming the print image, and is a liquid having a surface tension lower than that of the printing ink. Thus, the excessive printing ink transferred to the layer of the excessive ink removing liquid is in a floating state on the surface of the excessive ink removing liquid. As the contact member rotates, the excessive part of the printing ink being in a floating state on the surface layer of the contact member is removed from the contact member with the excessive ink removing liquid by a cleaning means being in contact with the surface of the contact member.

The excessive ink removing liquid containing the printing ink is separated by the separation means using a filter into the excessive ink removing liquid and the printing ink. The air-flow resistance per unit length of the filter is over 0.05; therefore, the printing ink will effectively be separated from the excessive ink removing liquid.

BRIEF DESCRIPTION OF THE DRAWINGS

FIG. 4 is a chart showing the specifications or characteristics of the filters used in the embodiments of the present invention and the other comparison example.

FIG. 5 is an evaluation chart comparing the embodiments of the present invention and the other comparison example regarding the performance of ink separation.

DETAILED DESCRIPTION OF THE EMBODIMENTS

Figure 1:
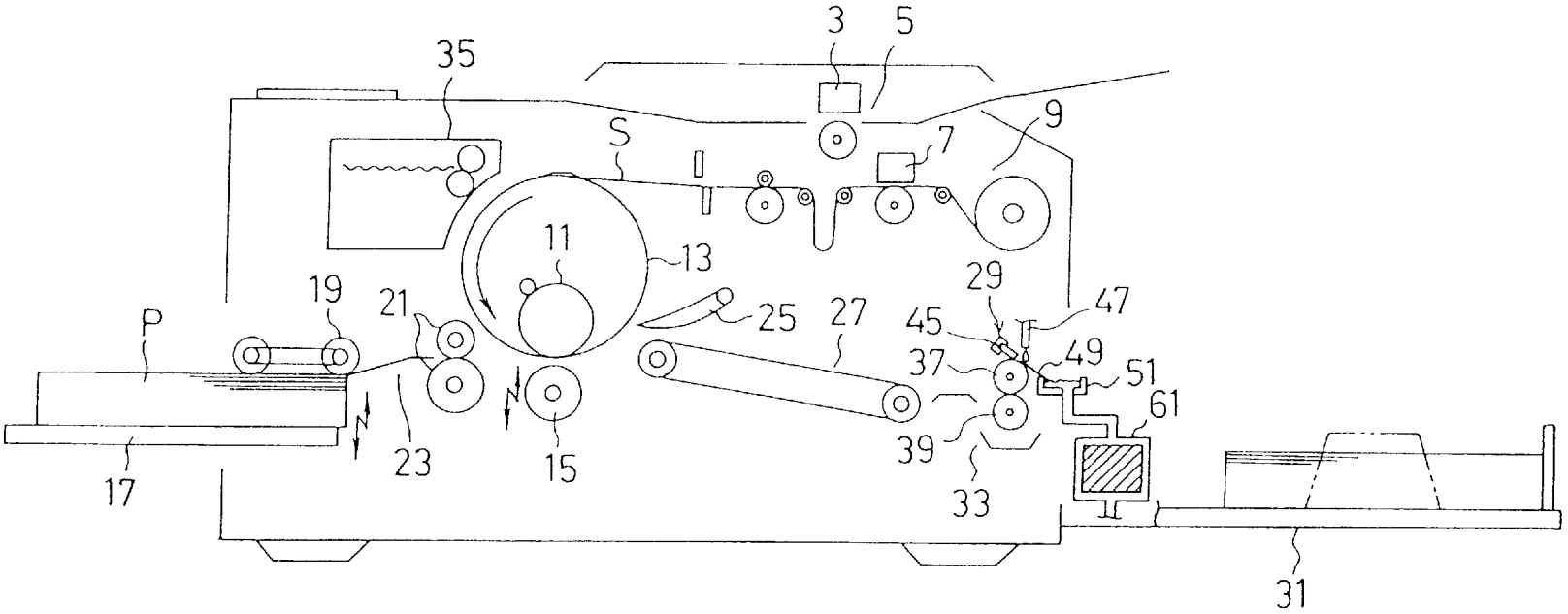
FIG. 1 is a plan view illustrating the constitution of one embodiment according to the present invention.

The constitution of the stencil printing device used in the first embodiment will be described with reference to FIG. 1 and FIG. 2. A copy image reader 5 has an image scanner 3 to read out a copy image for printing. A stencil making unit 9 has a stencil making device 7 to form a perforated image on a stencil sheet S for the stencil printing according to copy image data read out by the copy image reader 5.

The stencil sheet S for the stencil printing perforated by the stencil making unit 9 is wound up around the circumference of a cylindrical printing dram 13. Inside the printing dram 13, an ink supplier 11 including an ink squeegee is installed to supply ink to the inner surface of the printing dram 13. A press roller 15 movable up and down is placed under the printing dram 13. The press roller 15 and the printing dram 13 nip and carry a printed body P (e.g. a sheet, such as printed paper) supplied between them, forming a print image on the printed body P.

In a paper supply part 23, a paper feeder roller 19 feeds one by one the printed body P placed on a paper supply base 17, and the printed body P is fed between the press roller 15 and the printing dram 13 by a paper supply timing roller 21.

In a paper discharging part 33, a peeling claw 25 peels off the printed body P from the printing dram 13. The printed body P having been peeled off is carried to the print image after treatment device 29 by a conveyer 27 having a belt conveying mechanism. The print image after treatment device 29 removes an excessive ink from the print image on the printed body P. The printed body P having been treated is discharged and piled up onto a discharged paper tray 31.

The stencil sheet S for the stencil printing having completed a printing is taken off from the printing dram 13 by a plate discharging part 35, and is disposed.

The printing operation will now be described based on the foregoing constitution. The printing dram 13 rotates about the central axis of itself counterclockwise in the drawing, by a driving means as not illustrated in the drawing. The printed body P is carried, at a given timing synchronized with the rotation of the printing dram 13, from left to right in the drawing by the paper supply timing roller 21, and is fed into between the printing dram 13 and the press roller 15. The printed body P is pressed by the press roller 15 toward the stencil sheet S wound around on the circumference of the printing dram 13, on which the stencil printing is applied.

The printed body P already printed is peeled off from the printing dram 13 by the peeling claw 25 and is guided to the print image treatment device 29 with the print image upward by the conveyer 27 for conveying paper. The printed body P is treated by the print image treatment device 29; and is carried to the discharged paper tray 31 and piled up thereon.

The constitution and action of the print image treatment device 29 will now be described. As illustrated in FIG. 2, the print image treatment device 29 has a contact roller 37 for the contact member which comes into contact with the print image surface on the printed body P already printed, and a facing roller 39 for the facing member placed face to face with the contact roller 37. The contact roller 37 and the facing roller 39 are supported by a spindles 41 and 43 in parallel and rotatably, respectively. The facing roller 39 is urged upward, toward the contact roller 37 by a spring as an energizing means not illustrated in the drawing. When the printed body P is not present between the contact roller 37 and the facing roller 39, the contact roller 37 and the facing roller 39 are in contact with each other.

A blade 45, a plate member having an approximately rectangular cross section, is in contact with a circumference 37*a* (surface of excessive ink removing liquid) of the contact roller 37. The base end part of the blade 45 is fixed at an end of a metal member, the other end part of the blade 45 is in contact with the contact roller 37. The blade 45 is placed slightly above the top of the contact roller 37, and the lower corner part of the end part is in contact with the circumference 37*a* of the contact roller 37 on the front side of the top of the contact roller 37 in the rotating direction.

An excessive ink removing liquid supplying nozzle 47 is placed on the front side of the position where the contact roller 37 is in contact with the blade 45 in the rotating direction, above the circumference 37*a* of the contact roller 37. The excessive ink removing liquid supplying nozzle 47 is a means for supplying the excessive ink removing liquid onto the circumference 37*a* of the contact roller 37. The excessive ink removing liquid does not dissolve in the printing ink to form the print image, and has a lower surface tension than the printing ink.

When the excessive ink removing liquid supplying nozzle 47 is operated for supplying the excessive ink removing liquid onto the circumference 37*a* of the contact roller 37, the excessive ink removing liquid remains between the blade 45 and the contact roller 37. As the contact roller rotates, the excessive ink removing liquid passes through between the contact roller 37 and the blade 45 and forms a layer on the surface of the contact roller 37. At this time, the blade 45 functions so as to provide the uniform film thickness of the excessive ink removing liquid applied on the circumference 37*a* of the contact roller 37. Furthermore, the blade 45 functions as a cleaning means for removing dirts on the circumference 37*a* of the contact roller 37.

A sheet elastic body 49 is placed as a recovery means for the excessive ink removing liquid on the front side of the blade 45 in the rotating direction of the contact roller 37. The sheet elastic body 49 is a sheet member having a specific elasticity. The front end part of the sheet elastic body 49 is in contact with the circumference 37*a* of the contact roller 37 at a contact point (d) positioned on the front side of the contact position of the contact roller 37 with the blade 45 in the rotating direction of the contact roller 37. The sheet elastic body 49 is placed at a position nearer the contact roller 37 than the tangent (e) at the contact point (d) of the contact roller 37; the rear end part is at a position lower than the front end part. Therefore, a part of the front end of the sheet elastic body 49 comes into close contact with the circumference 37*a* of the contact roller 37 with a certain length; therefore, the above-mentioned front end part of the sheet elastic body 49 is elastically deformed according to the shape of the circumference 37*a* of the contact roller 37.

The rear end of the sheet elastic body 49 is fixed at a receiver plate 51 for receiving the excessive ink removing liquid placed at a lower position than the contact point (d). The front end of the sheet elastic body 49 is not fixed; and is in contact with the contact roller 37 as mentioned above. Thus, the sheet elastic body 49 is slant such that the free front end is in contact with the contact roller 37 and the fixed rear end is positioned downward.

On the bottom of the receiver plate 51, a conduit 60 is connected for discharging the excessive ink removing liquid. The conduit 60 is made of rubber and/or metal; and is guided to a filter 61 for a separation means. The filter 61 separates the excessive ink removing liquid containing the printing ink into the printing ink and the excessive ink removing liquid. Thus, the printing ink remains inside the filter 61, and the excessive ink removing liquid passes through the filter 61. On the bottom of the filter 61, the conduit 60 is connected, which is connected through a pump for a carrying means of the excessive ink removing liquid, not illustrated in the drawing, to the nozzle 47 for supplying the excessive ink removing liquid.

Since the filter 61 has an air-flow resistance per unit thickness over 0.05 [kPa·sec/m$^2$], the printing ink dispersed in the excessive ink removing liquid will be effectively recovered.

If the air-flow resistance per unit thickness is lower than 0.05, the printing ink will hardly be recovered, and will pass through the filter 61 with the excessive ink removing liquid. This air-flow resistance per unit thickness is preferably 0.2–5.0 [kPa·sec/m$^2$], in view of more effective recovery of the excessive ink removing liquid. If the filter has a higher air-flow resistance value than this, the printing ink will remain stationary on the surface of the filter, and will not come inside to lower the separation performance of the filter.

The aforementioned air-flow resistance (R) is defined by the following equation:

$$\text{ventilation resistance}(R)=\text{pressure differential}(p)/\text{quantity of air-flow per unit area }(V) \quad (2)$$

where the unit of the pressure differential (P) is Pa, and that of the quantity of airflow per unit area (V) is m$^3$/(m$^2$·sec).

The permeability tester of Blasius type is a device to obtain a quantity of air flow V passing through a test piece, by applying a specific pressure differential P (P=0.5 inch water pressure head, for example) to the test piece from both sides. The air-flow resistance (R) is obtained by using this tester and the equation (2). This tester also measures a pressure differential P at a specific quantity of an airflow V.

As to the material for the filter 61, all kinds of porous materials capable of allowing fluid to pass, such as non-woven fabric, woven fabric, gauze, filter paper, and sponge, can be used. There are, for nonwoven fabric, chemical fibers such as polyester, polypropylene, rayon, glass, acetate; and natural fibers such as sheep wool, hemp, asbestos. In addition, there are not any limits for the manufacturing method; any method can be applied for manufacturing these nonwoven fabrics. Furthermore, a porous material made by continuously foaming a continuous sheet of a resin can also be used.

The excessive ink removing liquid does not dissolve in the printing ink to form the print image on the print image surface of the printed body P, and is a liquid having a lower surface tension than the printing ink. There are liquids to meet this condition, for instance, dimethyl-siliconoil, and modified-siliconoil with phenyl, polyether, fluorine, amino, epoxy, carboxyl, carbinol, methacryl, mercapto, or phenol to be used for the excessive ink removing liquid. Besides, aqueous solutions with a surface active agent or an organic solvent added are also useful. However, most of their viscosity is less than 1(cps), so that the excessive ink removing liquid containing the printing ink may flow out through the part where the excessive ink removing liquid should primarily flow; and therefore, it is necessary to appropriately select it to prevent the excessive ink removing liquid from providing dirt to the printed body.

There are anion, cation, and ampholytic ionic and non-ionic surface active agents for a surface active agent to be added in water. The addition rate of each of these surface active agents is determined so that the surface tension of the excessive ink removing liquid is lower than that of the printing ink.

There are methanol, ethanol, isopropyl alcohol, n-isopropyl alcohol, ethylene, glycol, glycerin and the like, for an organic solvent to be added in water, or a water-soluble organic solvent.

The excessive ink removing liquid should be applied uniformly on the circumference 37*a* of the contact roller 37, and the application thickness is preferably 0.0001–1 $\mu$m. This is approximately equivalent to 0.1–100 mg/B4 size sheet, when converted into the application amount on the printed body.

The contact roller 37, facing roller 39, and blade 45 are comprised of a material which does not create decomposition such as swelling by the excessive ink removing liquid. When the basis material for the excessive ink removing liquid is, for instance, silicon oil; the contact roller 37, facing roller 39, and blade 45 are preferably comprised of fluorocarbon resin (rubber), phenyl metamorphic silicon resin (rubber), urethane rubber, or the like.

The action of the print image treatment device 29 constituted as above will now be described. The contact roller 37 and the facing roller 39 nip and carry the printed body P already printed. The film (a) of the excessive ink removing liquid formed on the circumference 37*a* of the contact roller 37 comes in contact with the print image surface on the printed body P. This contact transfers the excessive part of the printing ink (b) forming the print image on the printed body P to the film (a) of the excessive ink removing liquid on the contact roller 37; the excessive part of the printing ink is removed from the printed body P.

The printing ink (c) having been transferred to the film (a) of the excessive ink removing liquid on the contact roller 37 passes through a part where the sheet elastic body 49 and the contact roller 37 contact with each other with the rotation of the contact roller.

The excessive ink removing liquid used in this embodiment does not dissolve in the printing ink (b) forming the print image, and is a liquid having a lower surface tension than the printing ink (c). The film (a) of the excessive ink removing liquid on the contact roller 37 where the excessive printing ink (c) has been transferred is remove by the blade 45; the excessive ink removing liquid standing part (f) containing the printing ink (c) appears on the front side of the blade 45 in the rotating direction of the contact roller 37.

There is formed again the film (a) of the excessive ink removing liquid without containing the printing ink (c) on the circumference 37*a* of the contact roller 37, after the excessive ink removing liquid passes through the blade 45. The contact roller 37 having the film (a) of the excessive ink removing liquid without containing the printing ink (c) comes into contact with a subsequent print image on the printed body P; therefore, the printing ink (c) having been transferred to the contact roller 37 does not blur the print image on the printed body P.

Since the position where the blade 45 is in contact with the circumference 37*a* of the contact roller 37 is on the front side of the top of the contact roller 37 in the rotating direction, when the liquid quantity in the excessive ink removing liquid standing part (f) exceeds a certain limit, even if the contact roller is rotating, the excessive ink removing liquid in the excessive ink removing liquid standing part (f) flows out by its weight in the reverse direction to the rotation of the contact roller 37. The overflowing excessive ink removing liquid is guided to flow on the slant surface of the sheet elastic body 49, and is recovered into the receiver plate 51.

The excessive ink removing liquid containing the excessive printing ink is recovered by the filter 61, while being guided from the receiver plate 51 through the conduit 60. The filter 61 separates the excessive ink removing liquid containing the printing ink into the printing ink and the excessive ink removing liquid. Thus, the printing ink remains inside the filter 61, and the excessive ink removing liquid passes through the filter 61. The excessive ink removing liquid passed through the filter 61 returns back, by a pump, to the nozzle 47 for supplying the excessive ink removing liquid, and is reused on the circumference 37*a* of the contact roller 37.

As described above, the printed body P passes through between the contact roller 37 and the facing roller 39; the excessive part of the printing ink (b) forming the print image is removed reliably from the circumference 37*a* of the contact roller 37. Consequently, the set-off or seeping-through hardly occurs in the printed body already printed. When the print image surface is touched by a finger or the like immediately after being discharged, the print image becomes immune from being deformed, and drying the printing ink (b) forming the print image can be done in a shorter time. Besides, it is economical that the excessive ink removing liquid can be reused.

Next, example 1 to example 6 which are more specific modes of the above-mentioned embodiments, and the comparison example will be described..

(EXAMPLE 1)

Figure 2:
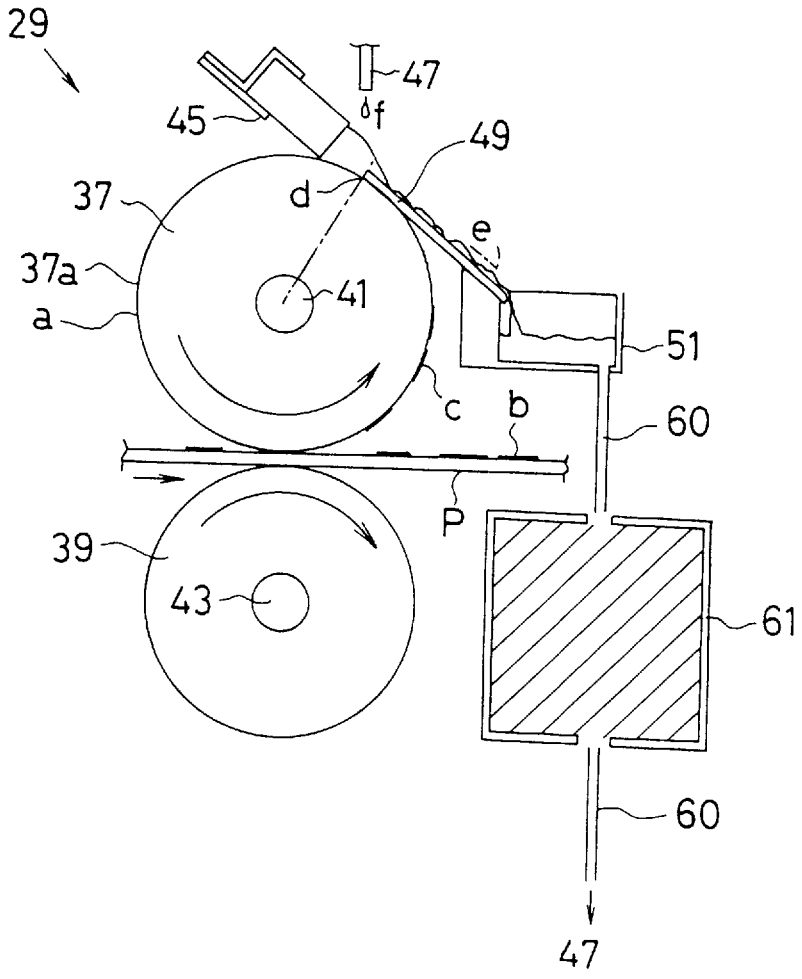
FIG. 2 is an enlarged plan view of the print image treatment device in FIG. 1.
Figure 3:
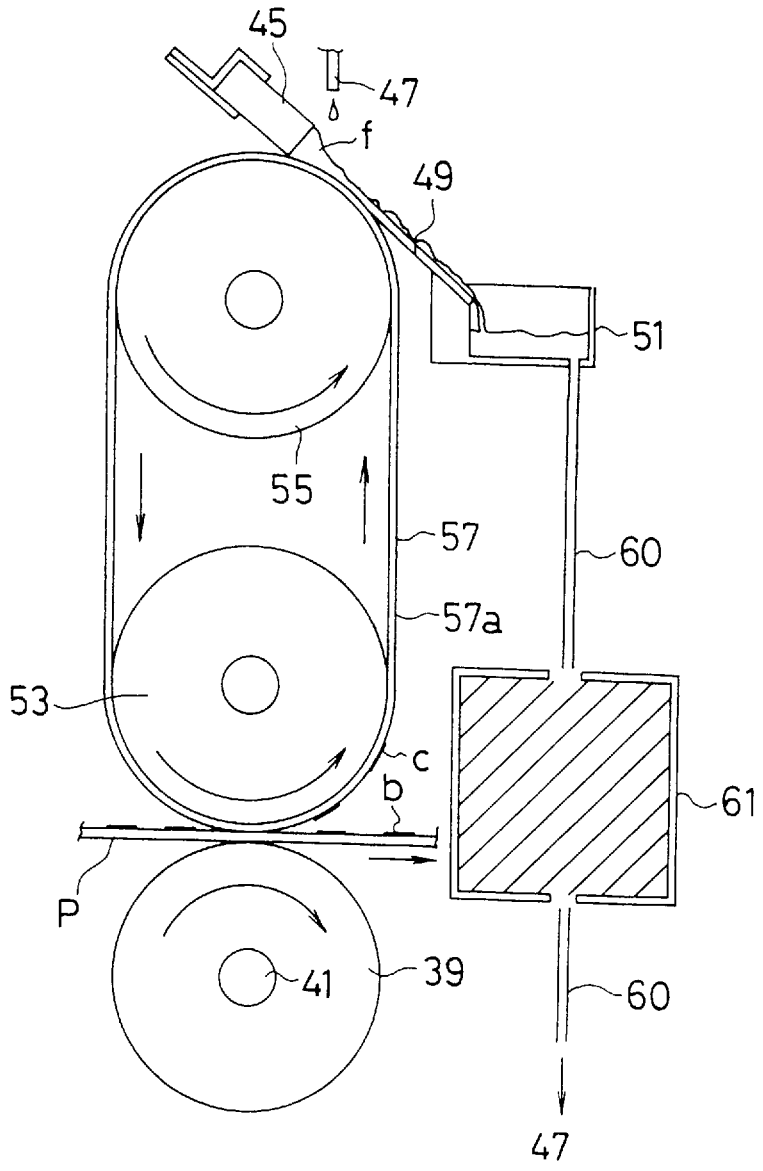
FIG. 3 is a plan view illustrating another constitution of the print image treatment device of the present invention.

The device according to the present invention, having the constitution as shown in FIG. 2 is set to a stencil printing machine (registered trademark, Lithograph RA 205, manufactured by RISO KAGAKU Corporation). After the baking treatment by polytetrafluoroethylene (P.T.F.E) is applied to the aluminum roller surface of the contact roller, the polishing treatment is applied thereto, and the contact roller thus treated was used.

Using a dimethylsilicon oil (KF-96, viscosity: 100 cps, manufactured by Shin-Etsu Chemical Company, Ltd.) for the excessive ink removing liquid, the stencil printing was conducted by adjusting the doctor blade setting condition so as to regulate the application quantity of the excessive ink removing liquid to 1 (mg/B4).

Example 1 uses the filter whose characteristics are shown in FIG. 4. A permeability tester: KED-F8-AP1 manufactured by KATO TEC Company. Ltd, was used for measuring the data showing the characteristics of these filters. The thickness of the filter was measured in nonloaded condition using a micrometer.

(EXAMPLE 2–6)

Using a similar device to the example 1, the example 2–6 uses the filter as shown in FIG. 4, respectively.

(COMPARATIVE EXAMPLE)

Using a similar device to the example 1, the comparison example uses the filter as shown in FIG. 4.

The results of the separation work in each example (example 1–6, and comparison example) were evaluated by a three-rating system: ○, Δ, X, according to the performance of separating the excessive ink removing liquid containing the excessive printing ink. The result is shown in FIG. 5.

Next, another embodiment based on the present invention will now be described with reference to FIG. 4. The description will be omitted as to the parts given the same symbol numbers in FIG. 4 as in FIG. 2. In this embodiment, a flexible endless belt 57 for a contact member is put on to bridge two rollers 53 and 55 placed separately in an upper and a lower position, with a certain tension applied. This embodiment will produce a similar effect to the foregoing embodiment.

According to the present invention, the printed sheet or body is pressed to the contact member by the facing member; the print image thereon comes into contact with the excessive ink removing liquid on the surface of the contact member. This contact will completely remove the excessive printing ink forming the print image on the printed body. Therefore, the set-off or the seeping-through will reliably be prevented without other defects involved, and the print image will hardly be deformed by finger-rubbing.

The excessive ink removing liquid does not dissolve in the printing ink forming the print image, and is a liquid having a surface tension lower than that of the printing ink. Thus, the excessive part of the printing ink having been transferred to the excessive ink removing liquid is in a floating state on the surface of the excessive ink removing liquid. The excessive printing ink being in a floating state on the surface of the excessive ink removing liquid can be removed by a cleaning means such as a blade for removing the excessive ink, which is in contact with the circumference of the contact roller.

The excessive ink removing liquid containing the excessive printing ink have been removed from the printed body is separated into the printing ink and the excessive ink removing liquid by the separation means installed in the device. The excessive ink removing liquid thus separated hardly contains the printing ink; can be reused without any difficulties.

What is claimed is:

1. A print image treatment device comprising:

supply means for supplying an excessive ink removing liquid, said excessive ink removing liquid not dissolving in a printing ink forming a print image and having a lower surface tension than that of the printing ink;

a rotating contact member having an outer surface, on which said excessive ink removing liquid is supplied from the supply means;

a facing member situated adjacent to the contact member for nipping and carrying a printing sheet having been printed between the contact member and the facing member, an excessive printing ink forming the print image on the printing sheet being transferred to the excessive ink removing liquid when the printing sheet contacts the contacting member;

cleaning means contacting the contact member for removing the excessive printing ink with the excessive ink removing liquid; and separation means receiving the excessive ink removing liquid with the excessive printing ink for separating the excessive ink removing liquid from a mixture containing the excessive printing ink having been transferred from the printing sheet and the excessive ink removing liquid, said separation means including a filter having the thickness and air-flow resistance indicated below:

$$0.05 < \text{air-flow resistance/thickness in units of Kpa·sec/m}^2.$$

2. A print image treatment device according to claim 1, wherein the cleaning means is formed of a plate member being in contact with the outer surface of the contact member on a front side of a top, in a rotating direction of the contact member.

3. A print image treatment device according to claim 2, wherein the supply means supplies the excessive ink removing liquid on the outer surface of the contact member on a front side of a contact position formed by the plate member and the contact member, in the rotating direction of the contact member.

4. A print image treatment device according to claim 3, further comprising a sheet elastic body for withdrawing the excessive ink removing liquid contacting the outer surface of the contact member on the front side of the contact position formed by the plate member and the contact member, in the rotating direction of the contact member.

5. A print image treatment device according to claim 1, wherein the contact member is an endless belt and a plurality of rollers for wrapping the endless belt.

6. A print image treatment device according to claim 1, wherein the contact member is a contact roller to nip the printed body having been printed between the facing member and the contact member.

* * * * *

UNITED STATES PATENT AND TRADEMARK OFFICE

CERTIFICATE OF CORRECTION

PATENT NO. : 5,845,570

DATED : December 8, 1998

INVENTOR(S) : Takashi Isozaki, et al

It is certified that error appears in the above-identified patent and that said Letters Patent is hereby corrected as shown below:

**On the Title Page, Item [*] Notice, "5,476,034" should read ---- 5,476,043 -----.**

Signed and Sealed this

Twenty-second Day of May, 2001

*Attest:*

Nicholas P. Godici

NICHOLAS P. GODICI

*Attesting Officer*

*Acting Director of the United States Patent and Trademark Office*